US011769623B2

(12) United States Patent
Otsubo et al.

(10) Patent No.: US 11,769,623 B2
(45) Date of Patent: Sep. 26, 2023

(54) COIL COMPONENT

(71) Applicant: Murata Manufacturing Co., Ltd., Kyoto (JP)

(72) Inventors: Yoshihito Otsubo, Kyoto (JP); Junji Kurobe, Kyoto (JP); Mitsuyoshi Nishide, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1172 days.

(21) Appl. No.: 15/586,706

(22) Filed: May 4, 2017

(65) Prior Publication Data

US 2017/0236635 A1 Aug. 17, 2017

Related U.S. Application Data

(63) Continuation of application No. PCT/JP2015/082077, filed on Nov. 16, 2015.

(30) Foreign Application Priority Data

Nov. 19, 2014 (JP) ..... 2014-234936

(51) Int. Cl.
*H01F 27/28* (2006.01)
*H01F 27/32* (2006.01)
(Continued)

(52) U.S. Cl.
CPC ..... *H01F 27/323* (2013.01); *H01F 17/0013* (2013.01); *H01F 17/06* (2013.01);
(Continued)

(58) Field of Classification Search
CPC ..... H01F 27/323; H01F 17/06; H01F 17/062; H01F 41/08; H01F 17/0013; H01F 41/043; H01F 27/2804; H01F 2017/002
See application file for complete search history.

(56) References Cited

U.S. PATENT DOCUMENTS 2,709,791 A * 5/1955 Anderson, Jr. ..... H01F 29/146 336/155
4,536,733 A * 8/1985 Shelly ..... H01F 27/06 336/182
(Continued)

FOREIGN PATENT DOCUMENTS

CN 102360902 A 2/2012
CN 103559996 A 2/2014
(Continued)

OTHER PUBLICATIONS

International Preliminary Report on Patentability issued in Patent Application No. PCT/JP2015/082077 dated May 23, 2017.
(Continued)

*Primary Examiner* — Mang Tin Bik Lian
(74) *Attorney, Agent, or Firm* — Pearne & Gordon LLP

(57) ABSTRACT

A coil electrode of a coil component includes a plurality of lower wiring patterns arranged on a lower surface of an insulating layer; a plurality of upper wiring patterns arranged on an upper surface of the insulating layer; a plurality of inner conductors disposed at an inner peripheral side of the coil core, each inner conductor connecting one end of the corresponding one of the lower wiring patterns and one end of a corresponding one of the upper wiring patterns forming the pair with the lower wiring pattern; and a plurality of outer conductors disposed at an outer peripheral side of the coil core, each outer conductor connecting the other end of the corresponding one of the lower wiring patterns and the other end of the corresponding one of the upper wiring patterns adjacent to an upper wiring pattern forming the pair with the lower wiring pattern.

17 Claims, 8 Drawing Sheets

(51) Int. Cl.

| | |
|---|---|
| ***H01F 17/06*** | (2006.01) |
| ***H01F 41/08*** | (2006.01) |
| ***H01F 17/00*** | (2006.01) |
| ***H01F 41/04*** | (2006.01) |

(52) U.S. Cl.
CPC ..... *H01F 27/2804* (2013.01); *H01F 41/043* (2013.01); *H01F 41/08* (2013.01)

(56) References Cited

U.S. PATENT DOCUMENTS

| | | | | |
|---|---|---|---|---|
| 5,055,816 | A * | 10/1991 | Altman | H01F 17/0033 336/200 |
| 6,417,754 | B1 * | 7/2002 | Bernhardt | H01L 23/5227 336/200 |
| 7,965,167 | B2 * | 6/2011 | Volker | G01N 27/025 336/229 |
| 8,633,703 | B2 * | 1/2014 | Eberheim | G01N 27/025 324/445 |
| 2006/0152322 | A1 * | 7/2006 | Whittaker | H05K 1/165 336/200 |
| 2009/0002111 | A1 * | 1/2009 | Harrison | H01F 41/046 336/96 |
| 2010/0295646 | A1 | 11/2010 | Harrison et al. | |
| 2011/0001590 | A1 * | 1/2011 | Wu | H01F 17/062 335/219 |
| 2011/0108317 | A1 * | 5/2011 | Harrison | H01F 17/0033 174/266 |
| 2011/0272094 | A1 | 11/2011 | Dalmia et al. | |
| 2012/0154097 | A1 | 6/2012 | Dalmia et al. | |
| 2014/0266548 | A1 * | 9/2014 | Brooksbank | H01F 17/062 336/200 |
| 2014/0266549 | A1 * | 9/2014 | Huang | H05K 1/165 336/200 |
| 2015/0262748 | A1 * | 9/2015 | Nishihata | H01F 37/005 29/602.1 |

FOREIGN PATENT DOCUMENTS

| | | | |
|---|---|---|---|
| EP | 2 109 861 | | 10/2009 |
| JP | 2010-516056 | A | 5/2010 |
| TW | 200901243 | A | 1/2009 |
| TW | 201340812 | A | 10/2013 |
| WO | 2008-084427 | A2 | 7/2008 |
| WO | 2008-088682 | A2 | 7/2008 |

OTHER PUBLICATIONS

International Search Report issued in Patent Application No. PCT/JP2015/082077 dated Dec. 15, 2015.

Written Opinion Issued in Patent Application No. PCT/JP2015/082077 dated Dec. 15, 2015.

* cited by examiner

COIL COMPONENT

This is a continuation of International Application No. PCT/JP2015/082077 filed on Nov. 16, 2015 which claims priority from Japanese Patent Application No. 2014-234936 filed on Nov. 19, 2014. The contents of these applications are incorporated herein by reference in their entireties.

BACKGROUND OF THE DISCLOSURE

Field of the Disclosure

The present disclosure relates to a coil component including an insulating layer and a coil electrode, a coil core being embedded in the insulating layer and the coil electrode being wound around the coil core.

Description of the Related Art

In an electronic device that uses high-frequency signals, a coil component is sometimes used for preventing noise. This type of coil component includes a coil core that is made of, for example, a magnetic material, and a coil electrode that is wound around the coil core. Here, the coil core is often manually wound around the coil electrode. Eliminating such a manual operation is an issue in reducing manufacturing costs of the coil component.

Accordingly, hitherto, a coil component not requiring such a manual winding operation has been proposed. For example, a coil component 100 shown in FIG. 9 and discussed in Patent Document 1 is a multilayer coil component, and includes a magnetic layer 101 and a coil electrode 102. The magnetic layer 101 includes a plurality of laminated magnetic sheets. The coil electrode 102 is formed at the magnetic layer 101.

The coil electrode 102 includes a plurality of lower wiring patterns 102*a* that are formed at a top surface of a lowest magnetic sheet, a plurality of upper wiring patterns 102*b* that are formed at a back surface of an uppermost magnetic sheet, and a plurality of columnar conductors 102*c*, each connecting a predetermined one of the upper wiring patterns 102*b* and a predetermined one of the lower wiring patterns 102*a*. Each columnar conductor 102*c* has a cylindrical shape formed by stacking via conductors, formed at the corresponding magnetic sheets, to a predetermined length. By virtue of these structures, the coil component 100 functions as a toroidal coil.

Patent Document 1: Japanese Patent No. 3109872 (paragraphs 0010 to 0013, FIG. 1, etc.)

BRIEF SUMMARY OF THE DISCLOSURE

There are some coil components of this type whose specification requires the flow of a large electric current through the coil electrode. Such coil components generate a large amount of heat when they are used. The generation of heat by such coil components may reduce the performance of other components that are used with such coil components. Therefore, improving heat dissipation characteristics of such coil components and reducing the resistance of the coil electrode are issues. In the existing coil component 100, these issues may be solved by increasing the diameter of each columnar conductor 102*c*. However, in the case of a toroidal coil whose winding axis circular, space that is provided at an inner side of the circle is limited. Therefore, when the diameter of the inner columnar conductors 102*c* at the inner side is increased, the number of turns of the coil electrode 102 is reduced. When the number of turns of the coil electrode 102 is reduced, the inductance value is reduced and, thus, the characteristics of the coil electrode 102 are reduced. Therefore, there is a demand for a technology that can reduce the resistance of coil electrodes and improve the heat dissipation characteristics without reducing the coil characteristics.

In view of the above-described problems, it is an object of the present disclosure to a provide a coil component that allows the resistance of a coil electrode to be reduced and heat dissipation characteristics to be improved without reducing the number of turns of the coil electrode, the coil component including an insulating layer in which an annular coil core is embedded and the coil electrode which is wound around the coil core.

To this end, according to the present disclosure, there is provided a coil component including an insulating layer in which an annular coil core is embedded and a coil electrode that is wound around the coil core. The coil electrode includes a plurality of first wiring patterns that are arranged on a first principal surface of the insulating layer, one end of each first wiring pattern being disposed at an inner peripheral side of the coil core and the other end of each first wiring pattern being disposed at an outer peripheral side of the coil core; a plurality of second wiring patterns that are arranged on a second principal surface of the insulating layer such that each second wiring pattern forms a pair with a corresponding one of the first wiring patterns, one end of each second wiring pattern being disposed at the inner peripheral side of the coil core and the other end of each second wiring pattern being disposed at the outer peripheral side of the coil core; a plurality of inner conductors that are disposed at the inner peripheral side of the coil core, each inner conductor connecting the one end of the corresponding one of the first wiring patterns and the one end of a corresponding one of the second wiring patterns that forms the pair with the first wiring pattern; and a plurality of outer conductors that are disposed at the outer peripheral side of the coil core, each outer conductor connecting the other end of the corresponding one of the first wiring patterns and the other end of the corresponding one of the second wiring patterns adjacent to a second wiring pattern that forms the pair with the first wiring pattern. At least one first wiring pattern is such that an area of a section of the outer conductor, which is connected to the other end, perpendicular to a thickness direction of the insulating layer is larger than an area of a section of the inner conductor, which is connected to the one end, perpendicular to the thickness direction of the insulating layer.

When the coil core has an annular shape, there is relatively enough design space at the outer peripheral side than at the inner peripheral side. Therefore, by making use of the flexibility in terms of design space, the area (cross-sectional area) of the section of each outer conductor perpendicular to the thickness direction of the insulating layer is larger than that of each inner conductor. This makes it possible to, compared to the volume of a metal composition in a coil component whose outer conductors and inner conductors have the same cross-sectional area, increase the volume of the metal composition. Therefore, it is possible to improve the heat-dissipation characteristics of the coil component.

When the cross-sectional area of each outer conductor is made large, for example, the sizes of connection surfaces between each outer conductor and the corresponding wiring patterns can be easily increased. Therefore, it is possible to reduce the resistance of the entire coil electrode.

Since only the cross-sectional area of the outer conductors disposed at the outer peripheral side of the coil core is made large, a reduction in the number of turns of the coil electrode, which is an obstacle to improving the heat dissipation characteristics of the coil component and to reducing the resistance of the coil electrode, does not occur.

Each inner conductor may include an inner columnar conductor; each outer conductor may include a plurality of outer columnar conductors; and a total of areas of sections of the outer columnar conductors perpendicular to the thickness direction of the insulating layer may be greater than an area of a section of a corresponding one of the inner columnar conductors perpendicular to the thickness direction of the insulating layer. In this case, when the number of outer columnar conductors is more than one, the cross-sectional area of each outer conductor (the area of the section of each outer conductor perpendicular to the thickness direction of the insulating layer) can be made larger than the cross-sectional area of each inner conductor.

Each inner conductor may include at least two inner columnar conductors; each outer conductor includes outer columnar conductors that are larger in number than the inner conductors; and a total of areas of sections of the outer columnar conductors perpendicular to the thickness direction of the insulating layer is greater than a total of areas of sections of the inner columnar conductors perpendicular to the thickness direction of the insulating layer. By virtue of this structure, when each inner conductor includes two or more inner columnar conductors, the cross-sectional area of each outer conductor can be made larger than the cross-sectional area of each inner conductor by forming the outer conductors from outer columnar conductors that are larger in number than the inner columnar conductors.

Each outer columnar conductor may be thicker than each inner columnar conductor. In this case, the cross-sectional area of each outer conductor can be easily made larger than the cross-sectional area of each inner conductor.

Each inner columnar conductor may be thicker than each outer columnar conductor. In this case, the difference between the areas of connection between each outer conductor and the corresponding wiring patterns and the areas of connection between each inner conductor and the corresponding wiring patterns can be reduced while making the cross-sectional area of each outer conductor larger than that of each inner conductor.

The outer columnar conductors may be arranged in one row along an outer periphery of the coil core. This makes it unnecessary to, even if the cross-sectional area of each outer conductor is larger than that of each inner conductor, widen the connection portions between the wiring patterns and each outer conductor to the outer side of the coil core. Therefore, it is possible to reduce the size of the coil component.

Each inner columnar conductor and each outer columnar conductor may be formed from a metal pin. In the case of through-hole conductors and via conductors, which require the formation of through holes, it is necessary to provide a predetermined interval between adjacent conductors to form independent through holes. Therefore, there is a limit to the number of turns of the coil that can be increased when the gap between adjacent conductors is narrowed. In contrast, in the case of metal pins, which do not require the formation of through holes, the gap between adjacent metal pins can be easily narrowed. Therefore, it is possible to easily increase the number of turns of the coil electrode.

Since the specific resistance of the metal pins is lower than the specific resistance of through-hole conductors and via conductors, formed by filling via holes with a conductive paste, the resistance value of the coil electrode as a whole can be reduced. Therefore, for example, the coil component can have good coil characteristics, such as a good Q value.

According to the present disclosure, compared to coil components whose outer conductors and inner conductors have the same volume, it is possible to increase the volume of the metal composition and to improve the heat dissipation characteristics of the coil component without reducing the number of turns of the coil electrode, the reduction being an obstacle thereto. In addition, since the size of connection surfaces between each outer conductor and the corresponding wiring patterns can be easily increased, it is possible to reduce the resistance of the coil electrode as a whole.

Figure 6A:
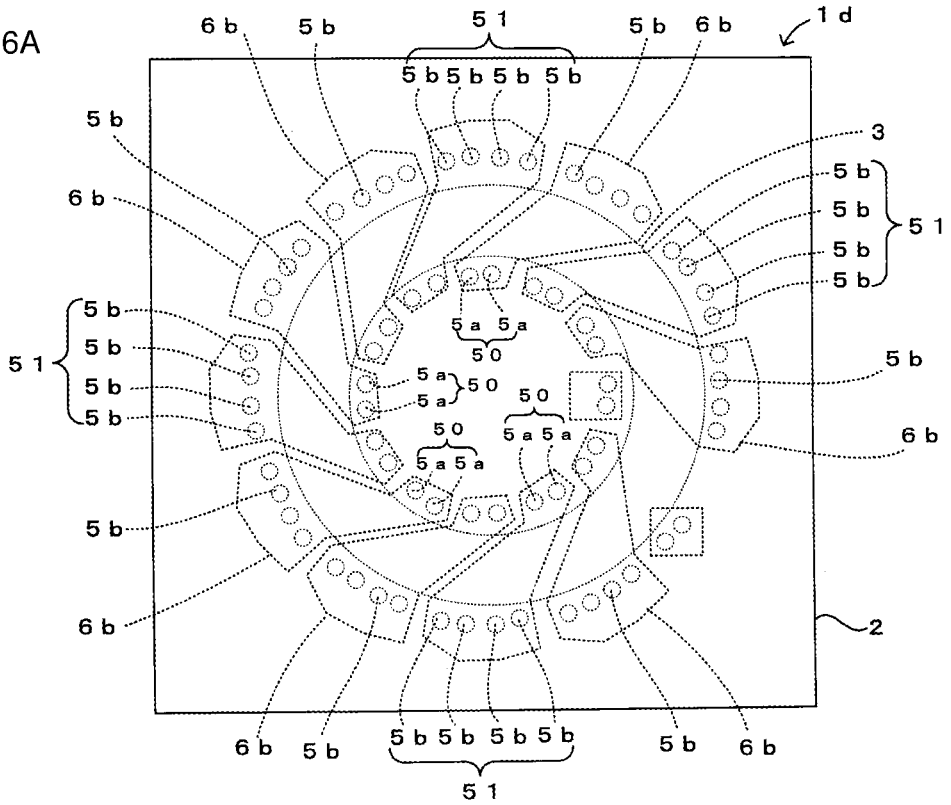
Figure 6B:
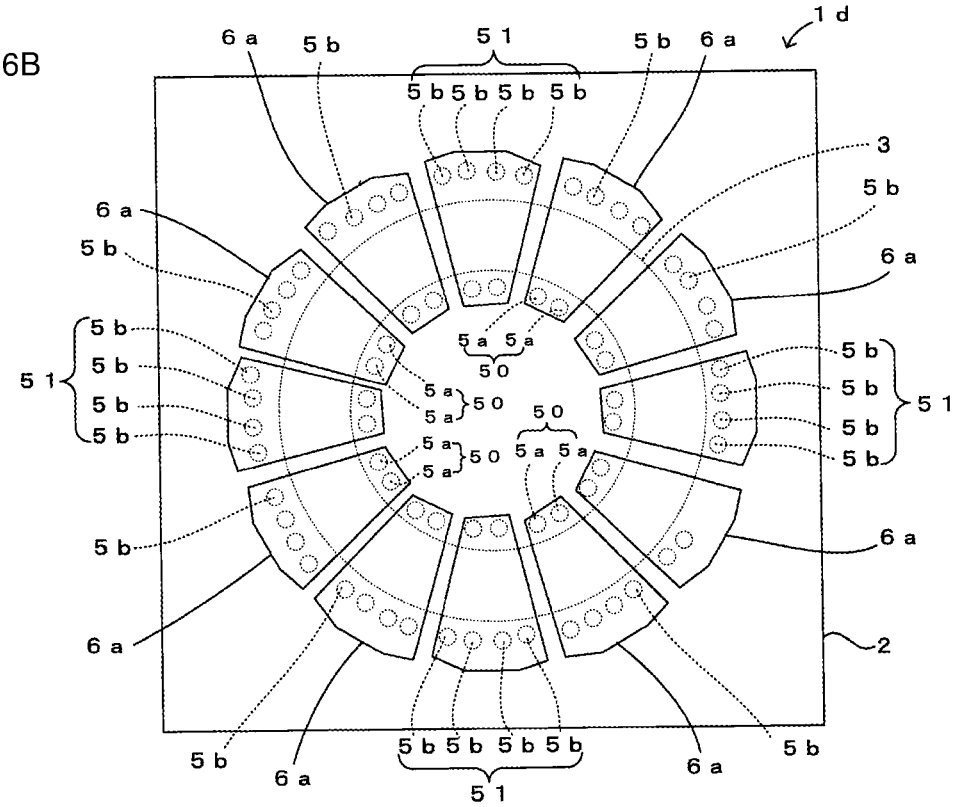

Each of FIGS. 6A and 6B illustrates a coil component according to a fourth embodiment of the present disclosure.

Figure 7:
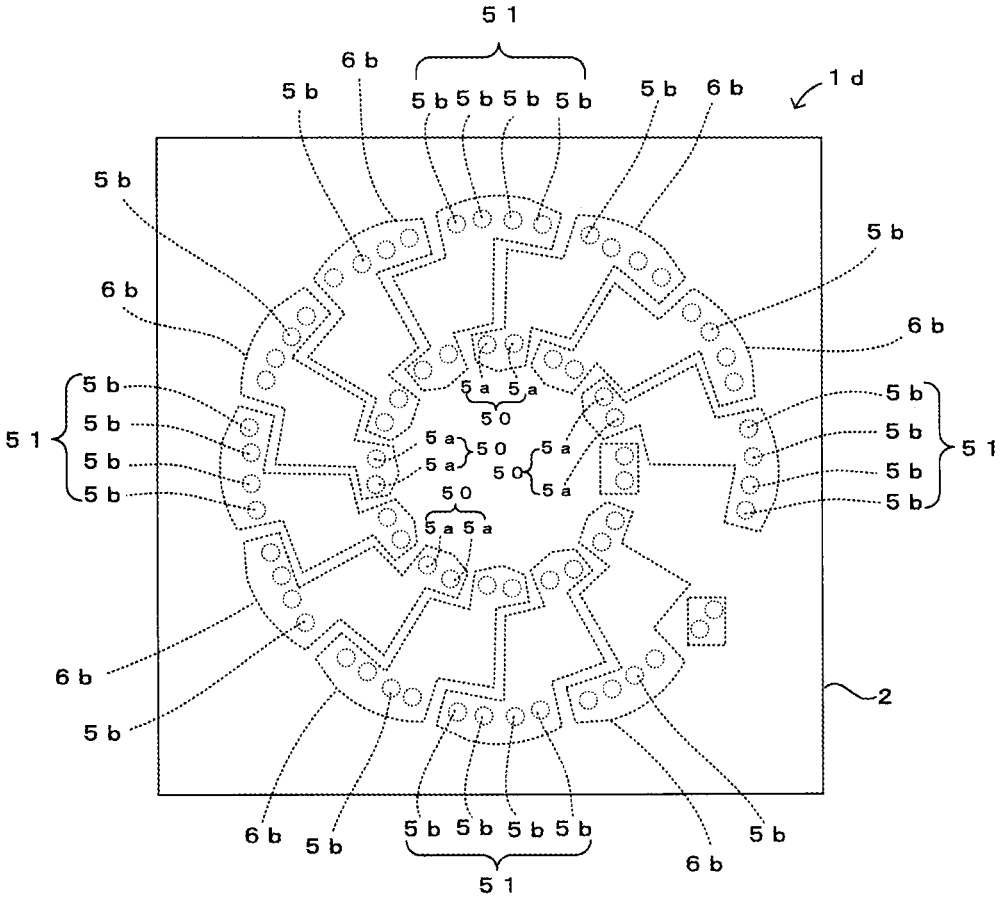

FIG. 7 illustrates wiring patterns according to a modification.

Figure 8A:
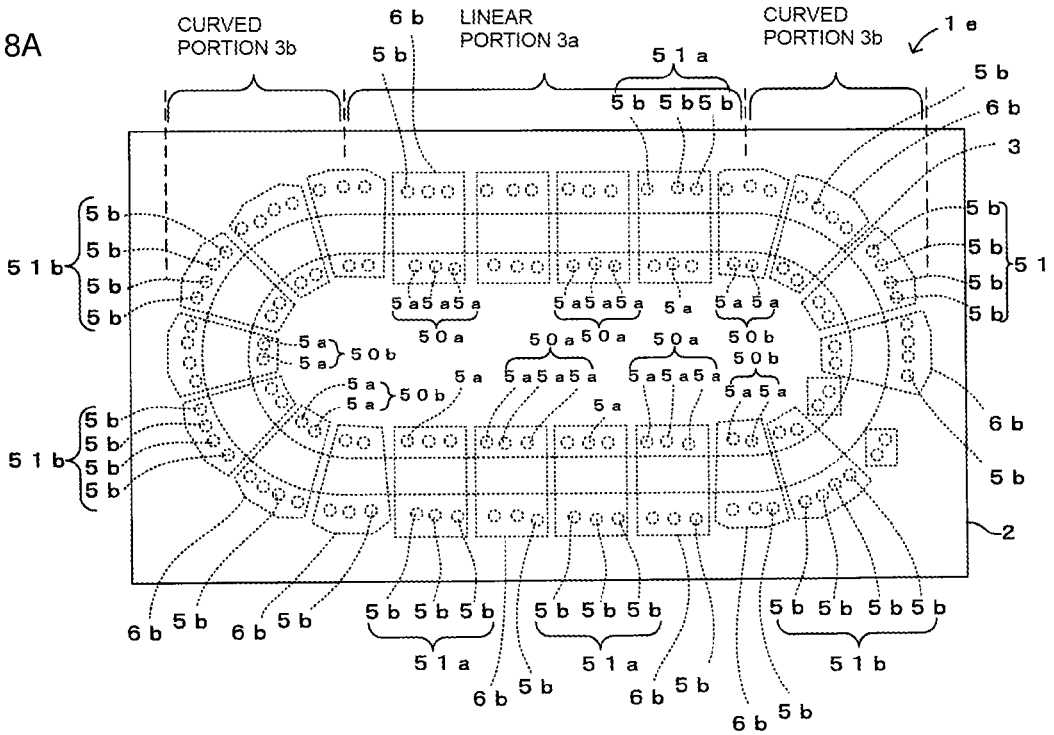
Figure 8B:
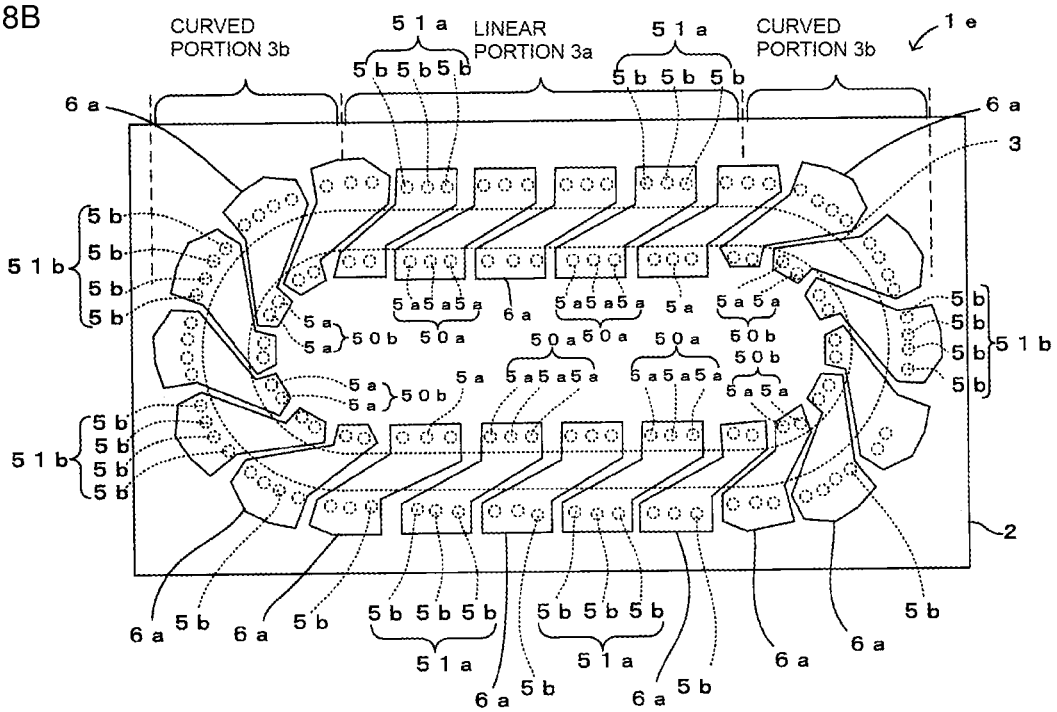

Each of FIGS. 8A and 8B illustrates a coil component according to a fifth embodiment of the present disclosure.

Figure 9:
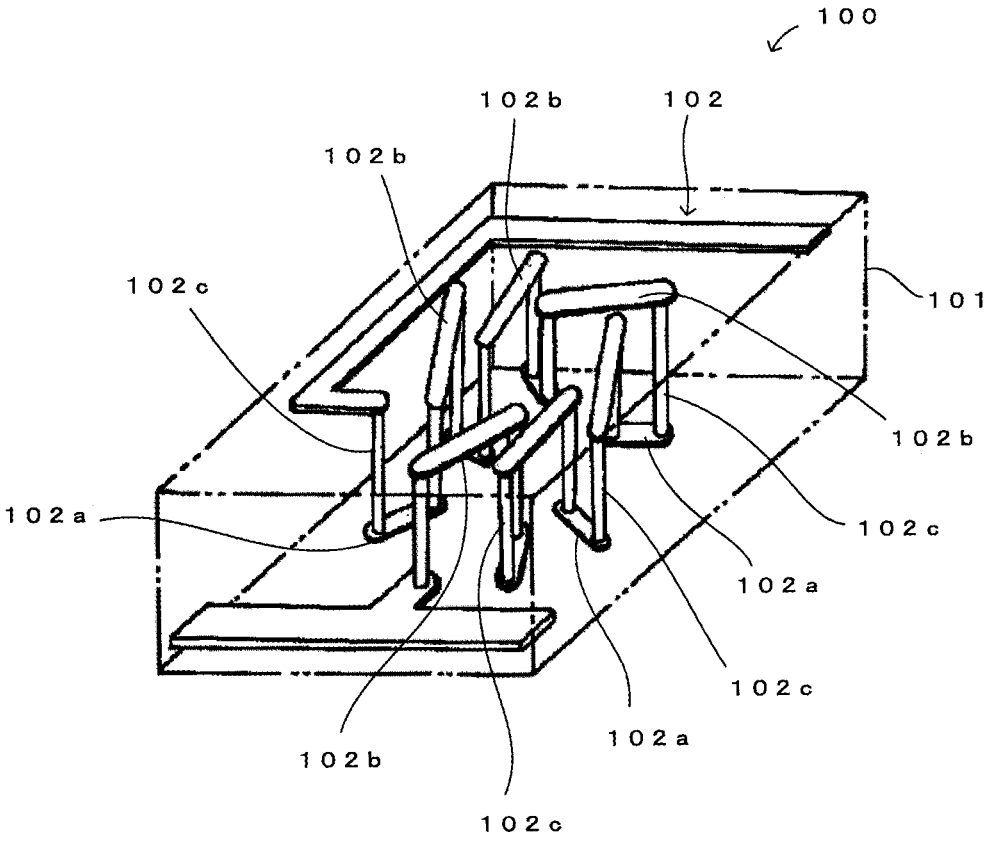
FIG. 9 PRIOR ART

FIG. 9 is a perspective view of an existing coil component.

DETAILED DESCRIPTION OF THE DISCLOSURE

First Embodiment

Figure 1:
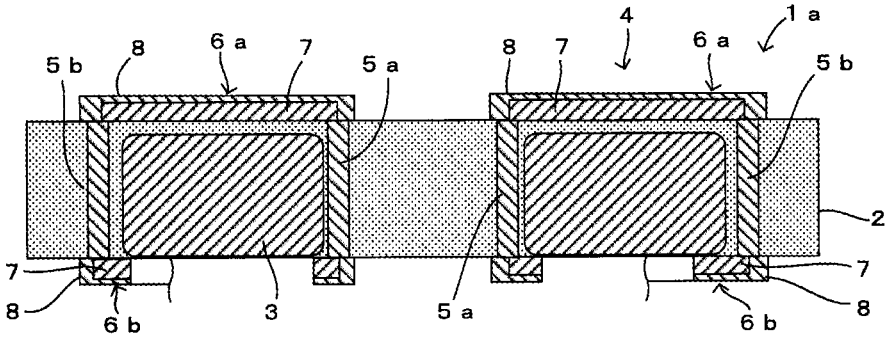
FIG. 1 is a sectional view of a coil component according to a first embodiment of the present disclosure.
Figure 2:
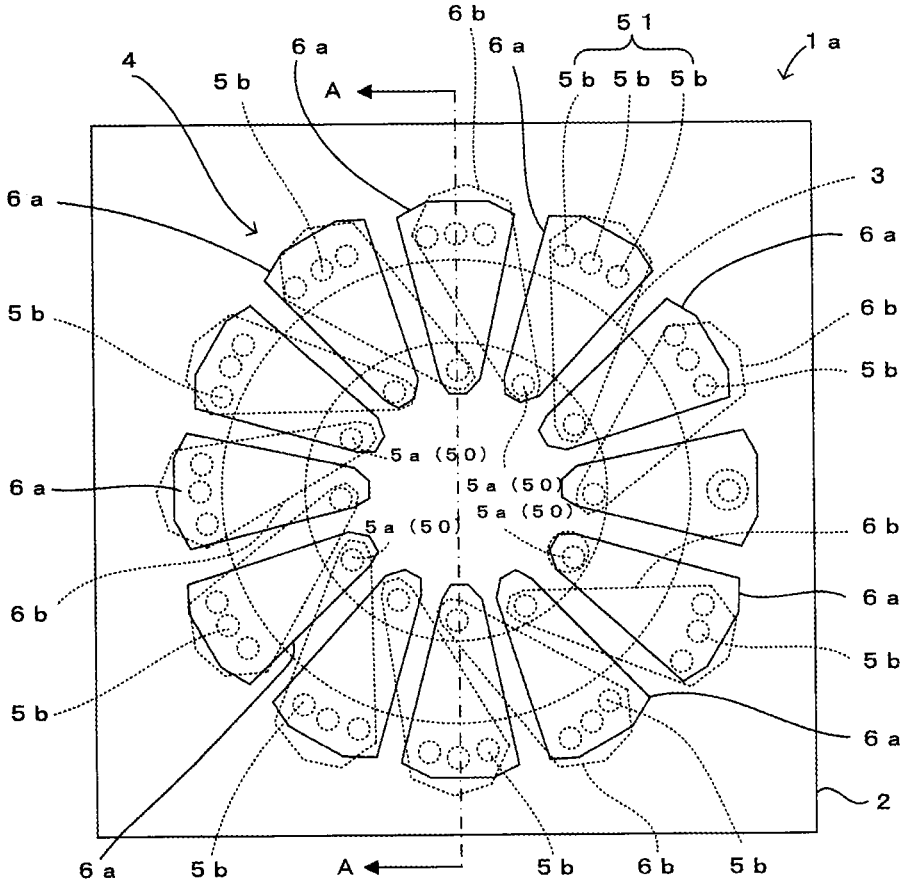
FIG. 2 is a plan view of the coil component in FIG. 1.
Figure 3A:
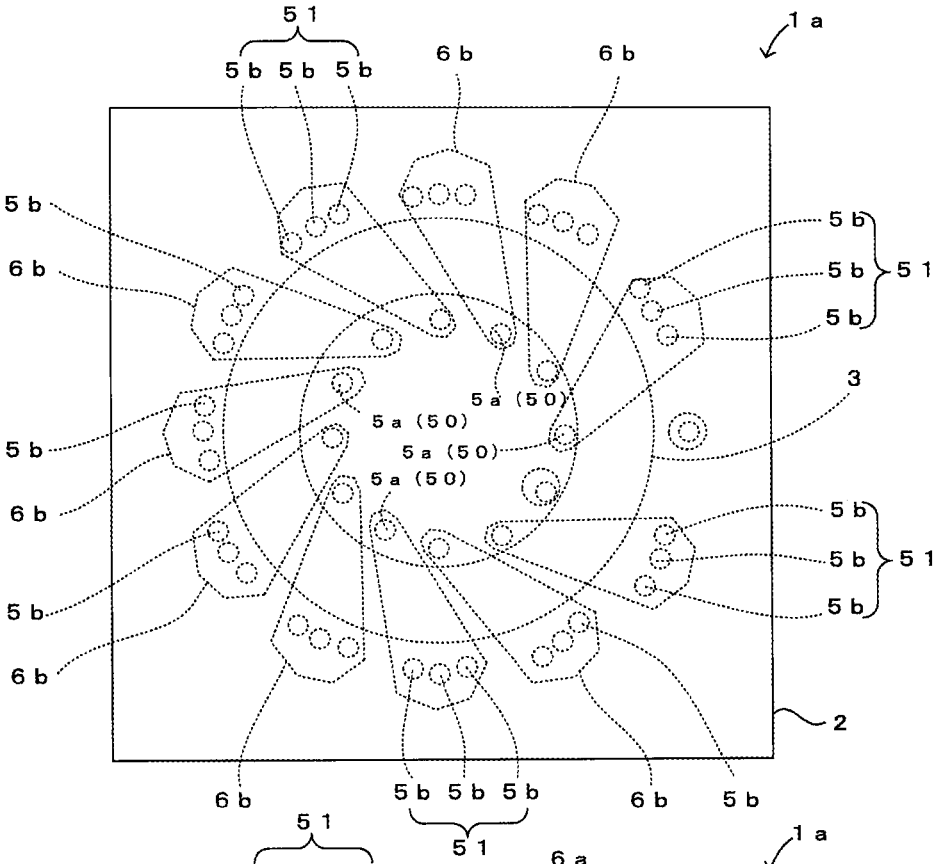
FIGS. 3A and 3B illustrate wiring patterns in FIG. 1.
Figure 3B:
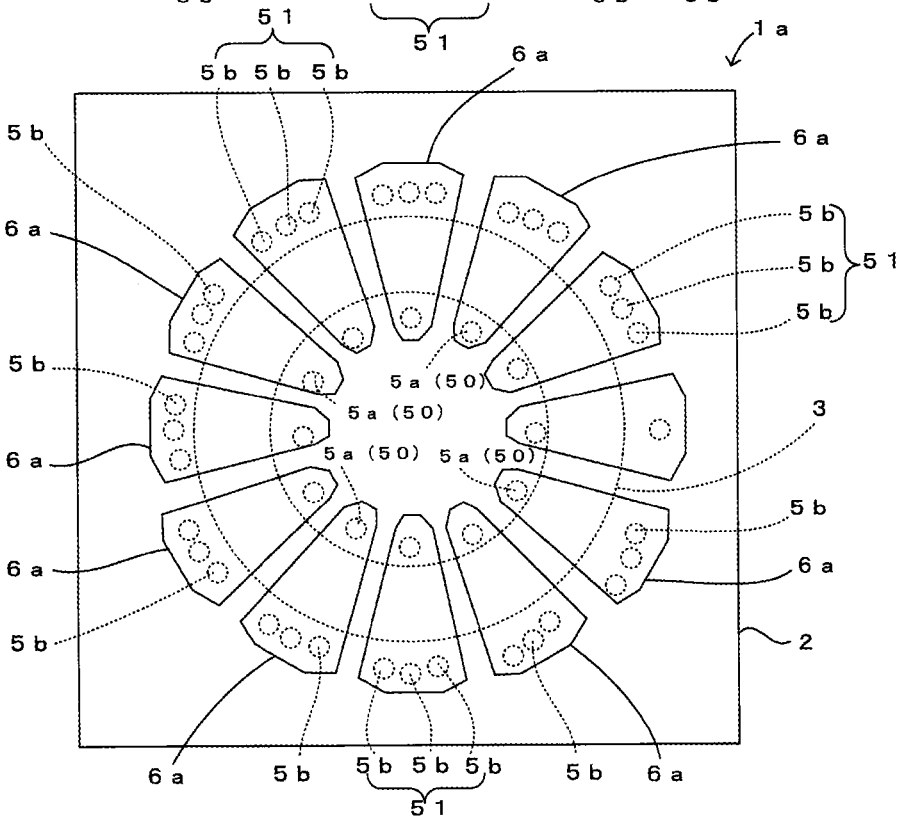

A coil component 1*a* according to a first embodiment of the present disclosure is described with reference to FIGS. 1 to 3B. FIG. 1 is a sectional view of the coil component 1*a*. FIG. 2 is a plan view of the coil component 1*a*. FIGS. 3A and 3B illustrate wiring patterns 6*a* and 6*b*. FIG. 3A is a plan view of the coil component 1*a* without the upper wiring patterns 6*a*. FIG. 3B is a plan view of the coil component 1*a* without the lower wiring patterns 6*b*. FIG. 1 is a sectional view taken along arrow A-A in FIG. 2. In FIG. 3A, input and output wires that are connected to end portions of a coil electrode 4 are not shown.

As shown in FIGS. 1 to 3B, the coil component 1*a* according to the embodiment includes an insulating layer 2 in which a coil core 3 is embedded and a coil electrode 4 which is wound around the coil core 3; and is mounted on an electronic device such as a cellular phone that uses high-frequency signals.

The insulating layer 2 is made of, for example, a resin such as an epoxy resin, and has a predetermined thickness so as to cover the coil core 3 and a plurality of metal pins 5*a* and 5*b*.

The coil core 3 is made of a magnetic material used as a general coil core made of, for example, Mn—Zn ferrite. The coil core 3 according to the embodiment has an annular shape.

The coil electrode 4 is spirally wound around the annular coil core 3. The coil electrode 4 includes a plurality of lower wiring patterns 6*b* that are formed at a lower surface of the insulating layer 2 (corresponding to a "first principal surface of the insulating layer" according to the present disclosure), a plurality of upper wiring patterns 6*a* that are formed at an upper surface of the insulating layer 2 (corresponding to a "second principal surface of the insulating layer" according to the present disclosure) such that each upper wiring pattern 6*a* forms a pair with a corresponding one of the lower wiring patterns 6*b*, and a plurality of inner conductors 50 and a plurality of outer conductors 51, each inner conductor 50 and each outer conductor 51 connecting a predetermined one of the lower wiring patterns 6*b* and a predetermined one of the upper wiring patterns 6*a* to each other.

The lower wiring patterns 6*b* are arranged in a peripheral direction such that one end of each lower wiring pattern 6*b* is disposed at an inner peripheral side of the coil core 3 and the other end of each lower wiring pattern 6*b* is disposed at an outer peripheral side of the coil core 3. Similarly to the lower wiring patterns 6*b*, the upper wiring patterns 6*a* are arranged in the peripheral direction such that one end of each upper wiring pattern 6*a* is disposed at the inner peripheral side of the coil core 3 and the other end of each upper wiring pattern 6*a* is disposed at the outer peripheral side of the coil core 3. In the embodiment, each upper wiring pattern 6*a* and each lower wiring pattern 6*b* taper from the outer peripheral side towards the inner peripheral side.

Each upper wiring pattern 6*a* and each lower wiring pattern 6*b* have a two-layer structure including an underlying electrode 7 that is formed by screen printing using a conductive paste containing a metal, such as Cu or Ag, and a surface electrode 8 that is provided on the corresponding underlying electrode 7 by, for example, Cu plating. Each upper wiring pattern 6*a* and each lower wiring pattern 6*b* may have a one-layer structure. In this case, similarly to each underlying electrode 7, each upper wiring pattern 6*a* and each lower wiring pattern 6*b* are formed by screen printing using a conductive paste containing a metal, such as Cu or Ag. Here, the upper wiring patterns 6*a* above correspond to "second wiring patterns" according to the present disclosure, and the lower wiring patterns 6*b* correspond to "first wiring patterns" according to the present disclosure.

Each inner conductor 50 connects the one end of the corresponding one of the lower wiring patterns 6*b* and the one end of a corresponding one of the upper wiring patterns 6*a*, each upper wiring pattern 6*a* forming the pair with the corresponding one of the lower wiring patterns 6*b*. In the embodiment, each inner conductor 50 includes one inner metal pin 5*a*. The inner metal pins 5*a* are arranged in one row along an inner peripheral surface of the coil core 3 with the inner metal pins 5*a* being disposed upright in a thickness direction of the insulating layer 2.

Each outer conductor 51 connects the other end of the corresponding one of the lower wiring patterns 6*b* and the other end of the corresponding one of the upper wiring patterns 6*a* adjacent to a predetermined side of an upper wiring pattern 6*a* (in a counterclockwise direction in the embodiment) that forms the pair with the lower wiring pattern 6*b*. In the embodiment, a plurality of outer metal pins 5*b* disposed upright in the thickness direction of the insulating layer 2 are arranged in one row along an outer peripheral surface of the coil core 3. Three outer metal pins 5*b* that are successively disposed in the peripheral direction form one set and constitute one outer conductor 51.

Upper end surfaces of the inner metal pins 5*a* and upper end surfaces of the outer metal pins 5*b* are exposed from the upper surface of the insulating layer 2, and lower end surfaces of the inner metal pins 5*a* and lower end surfaces of the outer metal pins 5*b* are exposed from the lower surface of the insulating layer 2. The metal pins 5*a* and 5*b* are made of metallic materials that are generally used as wiring electrodes, such as a Cu-based alloy, an Au-based alloy, an Ag-based alloy, an Al-based alloy, or a Cu-based alloy. In the embodiment, the metal pins 5*a* and 5*b* have substantially the same thickness and length, and have a cylindrical shape. The conductive paste forming each upper wiring pattern 6*a* and each lower wiring pattern 6*b* is formed by mixing a filler, made of Cu or Ag, with an organic solvent. Therefore, the specific resistance of each metal pin 5*a* and the specific resistance of each metal pin 5*b* are lower than the specific resistance of each upper wiring pattern 6*a* and the specific resistance of each lower wiring pattern 6*b*.

When a large electric current flows through the coil electrode 4, the coil electrode 4 generates a large amount of heat. The amount of heat generated is generally proportional to the resistance value of the coil electrode 4. Here, as a method of reducing the resistance value of the coil electrode 4, the volume of each inner conductor 50 and the volume of each outer conductor 51, in particular, the area of a section of each inner conductor 50 perpendicular to the thickness direction of the insulating layer 2 and the area of a section of each outer conductor 51 perpendicular to the thickness direction of the insulating layer 2 (hereunder referred to as "cross-sectional area") may be made large. However, since the inner peripheral side of the coil core 3 has a narrower space for disposing the metal pins 5*a* than the outer peripheral side of the coil core 3, increasing the volume (for example, the cross-sectional area) of each inner conductor 50 leads to reducing the number of turns of the coil electrode 4.

Therefore, in the embodiment, as described above, each inner conductor 50 that is disposed at the inner peripheral side of the coil core 3 includes one inner metal pin 5*a*, while each outer conductor 51 that is disposed at the outer peripheral side of the coil core 3 includes three outer metal pins 5*b*, so that the cross-sectional area of each outer conductor 51 (the total cross-sectional area of three outer metal pins 5*b*) is larger than the cross-sectional area of each inner conductor 50 (the cross-sectional area of one inner metal pin 5*a*). That is, when the volume of the outer conductors 51 is made large and the area of connection between each outer conductor 51 and the corresponding one of the upper wiring patterns 6*a* or the corresponding one of the lower wiring patterns 6*b* is made large, it is possible to, while maintaining the number of turns of the coil electrode 4, reduce the resistance value of the coil electrode 4 as a whole and improve heat dissipation characteristics of the coil component 1*a*.

Although, in the embodiment, each inner metal pin 5*a* and each outer meal pin 5*b* have a cylindrical shape, they may have, for example, a rectangular columnar shape. A portion corresponding to each inner metal pin 5*a* and a portion corresponding to each outer metal pin 5*b* may be formed from a columnar conductor, such as a via conductor.

(Method of Manufacturing Coil Component)

Next, an example of a method of manufacturing the coil component 1*a* is simply described.

First, each metal pin 5*a* and each metal pin 5*b* are disposed on a first principal surface of a planar transfer plate. In this case, the upper end surface of each metal pin 5*a* and the upper end surface of each metal pin 5*b* are secured to the first principal surface of the transfer plate such that each metal pin 5*a* and each metal pin 5*b* are disposed upright. Each metal pin 5*a* and each metal pin 5*b* may be formed by, for example, shearing a metal wire rod (made of, for example, an alloy of Cu, Au, Ag, Al, or Cu) whose transverse section is circular.

Next, a resin layer is formed on a first principal surface of a resin sheet (planar shape) with a release layer. In this case, the resin sheet, the release layer, and the resin layer are disposed in this order, and the resin layer is formed in an unsolidified state.

Next, after placing the transfer plate in a reversed state above the resin sheet such that the lower end surface of each metal pin 5*a* and the lower surface of each metal pin 5*b* contact the resin layer, the resin of the resin layer is solidified.

Next, after peeling off the transfer plate, the coil core 3 is disposed in a predetermined position on the resin sheet; and each metal pin 5*a*, each metal pin 5*b*, and the coil core 3 are subjected to molding by using, for example, epoxy resin to form the insulating layer 2 at the resin sheet.

Next, the resin sheet with the release layer is peeled off, and front and back surfaces of the insulating layer 2 are polished or grinded. This causes the upper end surface of each metal pin 5*a* and the upper end surface of each metal pin 5*b* to be exposed from the upper surface of the insulating layer 2, and the lower end surface of each metal pin 5*a* and the lower end surface of each metal pin 5*b* to be exposed from the lower surface of the insulating layer 2.

Lastly, each upper wiring pattern 6*a* is formed at the upper surface of the insulating layer 2, and each lower wiring pattern 6*b* is formed at the lower surface of the insulating layer 2, so that the coil component 1*a* is completed. Each upper wiring pattern 6*a* and each lower wiring pattern 6*b* may be formed by, for example, screen printing using a conductive paste containing a metal such as Cu. Each upper wiring pattern 6*a* and each lower wiring pattern 6*b* may be formed so as to have a two-layer structure by plating the wiring pattern, made of the conductive paste, with Cu. Each upper wiring pattern 6*a* and each lower wiring pattern 6*b* may be formed by another method. For example, first principal surfaces of plate-shaped members to which a Cu foil is attached are subjected to etching, and processed into the shape of predetermined patterns (the shape of the upper wiring patterns 6*a* or the shape of the lower wiring patterns 6*b*). The plate-shaped member for each upper wiring pattern 6*a* is separately provided from the plate-shaped member for each lower wiring pattern 6*b*. In this case, each upper wiring pattern 6*a* is joined to the upper end surfaces of the corresponding metal pins 5*a* and 5*b*, and each lower wiring pattern 6*b* is joined to the lower end surfaces of the corresponding metal pins 5*a* and 5*b* by ultrasonic joining using the plate-shaped members.

Therefore, the above-described embodiment provides the following advantages. More specifically, when the coil core 3 has an annular shape, there is relatively enough design space at the outer peripheral side than at the inner peripheral side. Therefore, by making use of the flexibility in terms of design space, the volume of the outer conductors 51 is set larger than the volume of the corresponding inner conductor 50. This makes it possible to, compared to the volume of a metal composition in a coil component whose outer conductors 51 and inner conductors 50 have the same cross-sectional area, increase the volume of a metal composition. Therefore, it is possible to improve the heat dissipation characteristics of the coil component 1*a*.

By forming one outer conductor 51 from three outer metal pins 5*b*, it is possible to easily increase the size of a connection surface between the outer conductor 51 and the corresponding wiring pattern 6*a* or the corresponding wiring pattern 6*b*. Therefore, it is possible to reduce the connection resistance between the wiring patterns 6*a* and 6*b* and the outer conductor 51. As a result, it is possible to reduce the resistance of the coil electrode 4 as a whole. By reducing the resistance value of the coil electrode 4 as a whole, it is possible to improve coil characteristics, such as a Q value. By reducing the resistance value of the coil electrode 4 as a whole and improving the heat dissipation characteristics of the coil component 1*a*, it is possible to deal with the issue related to a large electric current flowing through the coil component 1*a*.

Since only the volume and the cross-sectional area of the outer conductors 51 (the total cross-sectional area of three outer metal pins 5*b*) disposed at the outer peripheral side of the coil core 3 are made large, a reduction in the number of turns of the coil electrode 4, which is an obstacle to increasing the heat dissipation characteristics of the coil component 1*a* and to reducing the resistance of the coil electrode 4, does not occur.

When the metal pins 5*a* and 5*b* have the same shape (length and cross-sectional area), the inner conductors 50 and the outer conductors 51 can be made of the same material (the metal pins 5*a* and 5*b*). Therefore, it is possible to reduce manufacturing costs of the coil component 1*a*.

In the case of the metal pins 5*a* and 5*b*, compared to via conductors and through-hole conductors, where through holes need to be formed in the insulating material 2, a gap between adjacent metal pins 5*a* and 5*b* can be easily narrowed. Therefore, it is possible to easily increase the number of turns of the coil electrode 4. Since the specific resistance of the metal pins 5*a* and 5*b* is lower than the specific resistance of through-hole conductors and via conductors, formed by filling via holes with conductive paste, the resistance value of the coil electrode 4 as a whole can be reduced. Therefore, for example, the coil component 1*a* can have good coil characteristics, such as a good Q value.

The outer metal pins 5*b* are arranged in one row along the outer peripheral surface of the coil core 3. Therefore, even if the volume and the cross-sectional area of the outer conductors 51 are larger than those of the inner conductors 50, it is possible to suppress an increase in the size of the coil component 1*a*.

Second Embodiment

Figure 4:
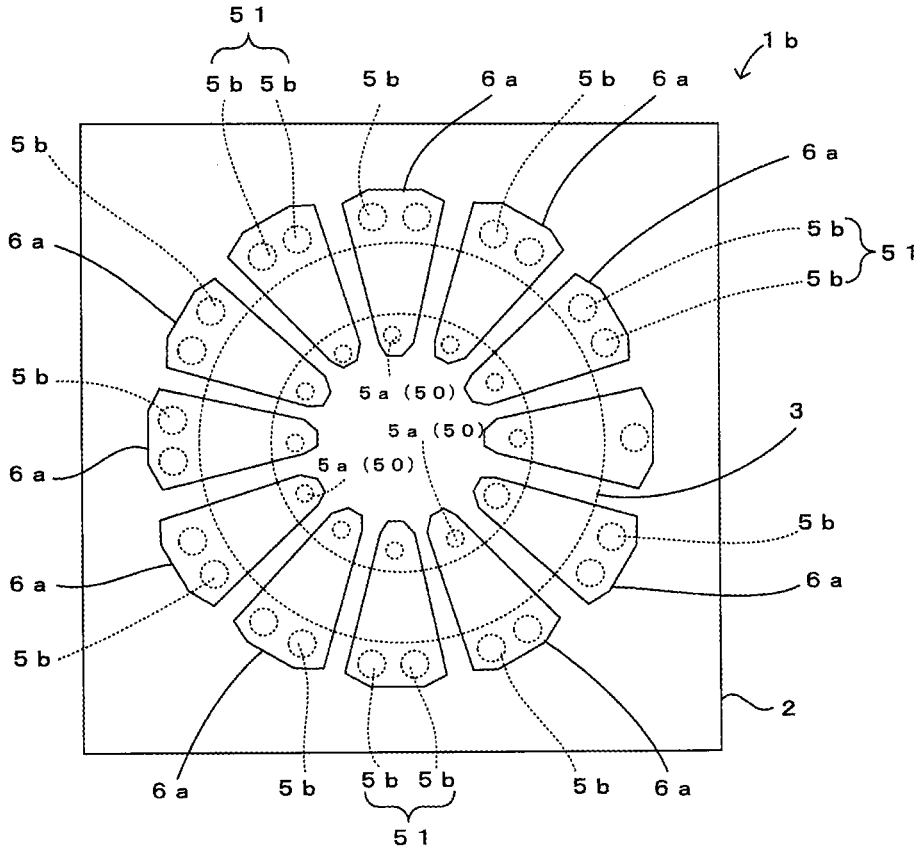
FIG. 4 illustrates a coil component according to a second embodiment of the present disclosure.

A coil component 1*b* according to a second embodiment of the present disclosure is described with reference to FIG. 4. FIG. 4 is a plan view of the coil component 1*b* without lower wiring patterns 6*b*, and corresponds to FIG. 3B.

The coil component 1*b* according to this embodiment differs from the coil component 1*a* according to the first embodiment described with reference to FIGS. 1 to 3B as follows. That is, as shown in FIG. 4, the coil component 1*b* differs therefrom in the number of outer metal pins 5*b* that make up each outer conductor 51, and in that the outer metal pins 5*b* are thicker than inner metal pins 5*a* (excluding the metal pin for external connection). The other structural features are the same as those of the coil component 1*a* according to the first embodiment. Therefore, such other structural features are given the same reference numerals, and are not described.

In this case, each outer conductor 51 includes two outer metal pins 5*b*, and is thicker than the inner metal pins 5*a*. Here, the outer metal pins 5*b* have the same thickness and the same length. In contrast, the inner metal pins 5*a* are such that one inner metal pin 5*a* has the same length and the same thickness as the outer metal pins 5*b*, and the remaining inner metal pins 5*a* are thinner than the outer metal pins 5*b*. The thick inner metal pin 5*a* is used as a metal pin for external connection.

This structure makes it possible to make the volume and the cross-sectional area of the outer conductors 51 larger than the volume and the cross-sectional area of the inner conductors 50. Therefore, it is possible to provide the same advantages as those provided by the coil component 1*a* according to the first embodiment.

Third Embodiment

Figure 5:
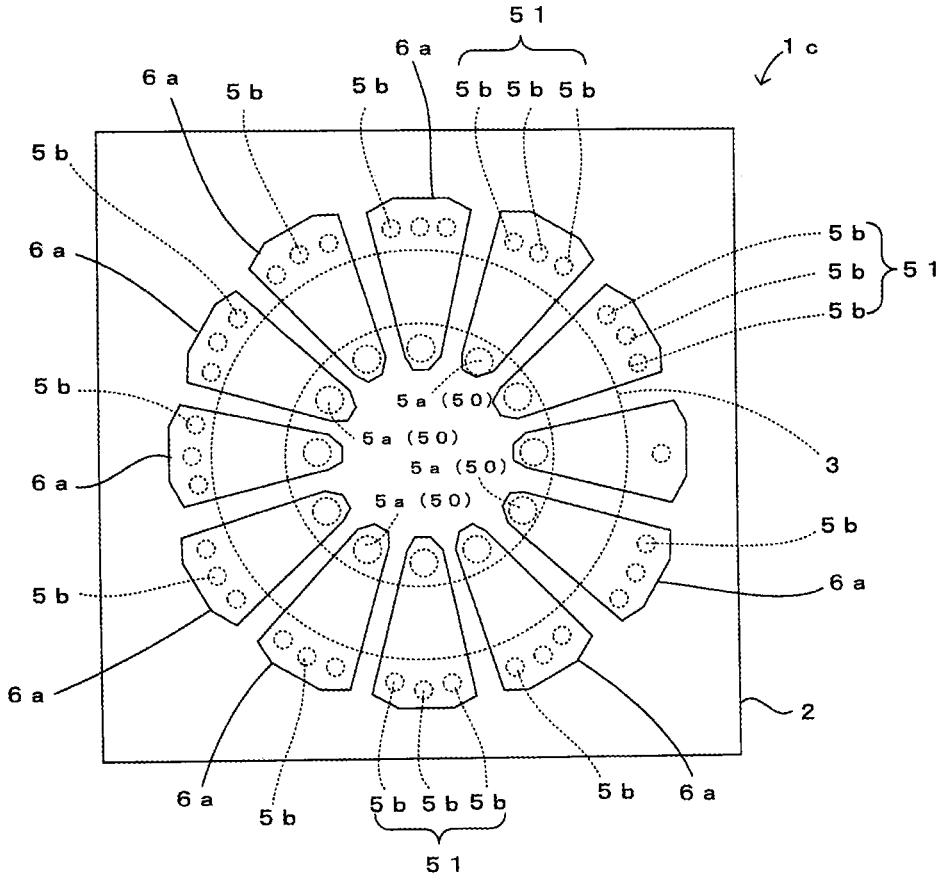
FIG. 5 illustrates a coil component according to a third embodiment of the present disclosure.

A coil component 1*c* according to a third embodiment of the present disclosure is described with reference to FIG. 5. FIG. 5 is a plan view of the coil component 1*c* without lower wiring patterns 6*b*, and corresponds to FIG. 3B.

The coil component 1*c* according to this embodiment differs from the coil component 1*a* according to the first embodiment described with reference to FIGS. 1 to 3B as follows. That is, as shown in FIG. 5, the coil component 1*c* differs therefrom in that inner metal pins 5*a* are thicker than outer metal pins 5*b*. The other structural features are the same as those of the coil component 1*a* according to the first embodiment. Therefore, such other structural features are given the same reference numerals, and are not described.

In this case, the outer metal pins 5*b* have the same thickness and the same length, and the inner metal pins 5*a* have the same thickness and the same length. Each inner metal pin 5*a* is thicker than each outer metal pin 5*b*. In addition to providing the same advantages as those provided by the coil component 1*a* according to the first embodiment, this structure allows the difference between an area of connection between each inner conductor 50 and the corresponding wiring pattern 6*a* or 6*b* and an area of connection between each outer conductor 51 and the corresponding wiring pattern 6*a* or 6*b* to be small. In this case, the difference between a connection resistance between each inner conductor 50 and the corresponding wiring pattern 6*a* or 6*b* and a connection resistance between each outer conductor 51 and the corresponding wiring pattern 6*a* or 6*b* can be made small.

Fourth Embodiment

A coil component 1*d* according to a fourth embodiment of the present disclosure is described with reference to FIGS. 6A and 6B. FIG. 6A is a plan view of the coil component 1*d* without upper wiring patterns 6*a*, and FIG. 6B is a plan view of the coil component 1*d* without lower wiring patterns 6*b*.

The coil component 1*d* according to this embodiment differs from the coil component 1*a* according to the first embodiment described with reference to FIGS. 1 to 3B as follows. That is, as shown in FIGS. 6A and 6B, the coil component 1*d* differs therefrom in that each inner conductor 50 includes two inner metal pins 5*a*, in that each outer conductor 51 includes four outer metal pins 5*b*, and in the shape of the lower wiring patterns 6*b*. The other structural features are the same as those of the coil component 1*a* according to the first embodiment. Therefore, such other structural features are given the same reference numerals, and are not described.

In this case, one inner conductor 50 includes a plurality of inner metal pins 5*a* (in this embodiment, two metal pins 5*a*), and one outer conductor 51 includes outer metal pins (in this embodiment, four outer metal pins 5*b*) that are larger in number than the inner metal pins 5*a* that make up one inner conductor 50. Here, the inner metal pins 5*a* and the outer metal pins 5*b* have the same thickness and the same length. Therefore, the volume and the cross-sectional area of the outer conductors 51 can be made larger than the volume and the cross-sectional area of the inner conductors 50.

In plan view, a portion of each upper wiring pattern 6*a* that is positioned outwardly from the coil core 3 has substantially the same shape as a portion of each outer wiring pattern 6*b* that is positioned outwardly from the coil core 3, the lower wiring patterns 6*b* being connected to the corresponding upper wiring patterns 6*a*. A portion of each upper wiring pattern 6*a* that is positioned inwardly from the coil core 3 also has substantially the same shape as a portion of each lower wiring pattern 6*b* that is positioned inwardly from the coil core 3. Therefore, in addition to providing the same advantages as those provided by the coil component 1*a* according to the first embodiment, this structure makes it possible to easily connect the upper wiring patterns 6*a* and the lower wiring patterns 6*b* to each other even if each inner conductor 50 includes the plurality of metal pins 5*a* and each outer conductor 51 includes the plurality of metal pins 5*b*.

(Modification of Lower Wiring Patterns)

Next, a modification of the lower wiring patterns 6*b* is described with reference to FIG. 7. FIG. 7 illustrates a modification of the lower wiring patterns 6*b*, and does not illustrate the upper wiring patterns 6*a* and the coil core 3.

The shape of each lower wiring pattern 6*b* of the coil component 1*d* may be changed as appropriate. For example, in plan view, a portion of each lower wiring pattern 6*b* according to the embodiment shown in FIG. 7 that is positioned outwardly from the coil core 3 and a portion of each lower wiring pattern 6*b* according to the embodiment shown in FIG. 7 that is positioned inwardly from the coil core 3 have, as in the above-described coil component 1*d*, substantially the same shapes as a portion of each upper wiring pattern 6*a* that is positioned outwardly from the coil core 3 and a portion of each upper wiring pattern 6*a* that is positioned inwardly from the coil core 3. However, in plan view, the shape of a portion that connects the corresponding portion that is positioned outwardly from the coil core 3 and the corresponding portion that is positioned inwardly from the coil core 3 of each lower wiring pattern 6*b* differs from that of a portion that connects the corresponding portion that is positioned outwardly from the coil core 3 and the corresponding portion that is positioned inwardly from the coil core 3 of each lower wiring pattern 6*b* according to the above-described fourth embodiment. Even if each lower wiring pattern 6*b* has such a shape, it is possible to provide the same advantages as those provided by the coil component 1*d* according to the fourth embodiment.

Fifth Embodiment

A coil component 1*e* according to a fifth embodiment of the present disclosure is described with reference to FIGS. 8A and 8B. FIG. 8A is a plan view of the coil component 1*e* without upper wiring patterns 6*a*, and FIG. 8B is a plan view of the coil component 1*e* without lower wiring patterns 6*b*. In FIG. 8A, an input/output wire that is connected to an end portion of a coil electrode 4 is not shown.

The coil component 1*e* according to this embodiment differs from the coil component 1*a* according to the first embodiment described with reference to FIGS. 1 to 3B as follows. That is, as shown in FIGS. 8A and 8B, the coil component 1*e* differs therefrom in that the coil core 3 has an elliptical shape, in the structures of inner conductors 50*a* and 50*b* and outer conductors 51*a* and 51*b*, and in the shapes of upper wiring patterns 6*a* and lower wiring patterns 6*b*. The other structural features are the same as those of the coil component 1*a* according to the first embodiment. Therefore, such other structural features are given the same reference numerals, and are not described.

In this case, the coil core 3 has an elliptical shape defined by a linear portion 3*a* at the center thereof and curved portions 3*b* at two ends thereof. Here, the number of metal pins 5*a* of each inner conductor 50*a*, disposed in the linear portion 3*a*, and the number of metal pins 5*b* of each outer conductor 51*a*, disposed in the linear portion 3*a*, are the same (in the embodiment, three metal pins). In contrast, each outer conductor 51*b*, disposed in the corresponding curved portion 3*b*, includes four outer metal pins 5*b*, and each inner conductor 50*b*, disposed in the corresponding curved portion 3*b*, includes two inner metal pins 5*a*. That is, in the linear portion 3*a*, where the amount of sufficient space for disposing the metal pins 5*a* and the amount of sufficient space for disposing the metal pins 5*b* are substantially the same at the inner side as at the outer side of the coil core 3, the number of metal pins 5*a* of each inner conductor 50*a* and the number of metal pins 5*b* of each outer conductor 51*a* are the same. In contrast, in the curved portions 3*b*, where the amounts of sufficient space differ, the number of inner metal pins 5*a* of each inner conductor 50*b* is less than the number of outer pins 5*b* of each outer conductor 51*b*.

According to this structure, when the coil core 3 of the coil component 1*e* has an elliptical shape, it is possible to provide the same advantages as those provided by the coil component 1*a* according to the first embodiment.

The present disclosure is not limited to the above-described embodiments. Various changes may be made in addition to those described above without departing from the gist of the present disclosure. For example, the insulating layer 2 may be made of, for example, a ceramic material.

A protective layer that protects the upper wiring patterns 6*a* and the lower wiring patterns 6*b* may be provided at the upper surface and the lower surface of the insulating layer 2. In this case, the protective layer may be made of, for example, epoxy resin or polyimide resin.

The present disclosure is widely applicable to various types of coil components including an insulating layer in which an annular coil core is embedded and a coil electrode which is wound around the coil core.

1*a*~1*e* coil component
2 insulating layer
3 coil core
4 coil electrode
5*a* inner metal pin
5*b* outer metal pin
6*a* upper wiring pattern (second wiring pattern)
6*b* lower wiring pattern (first wiring pattern)
50, 50*a*, 50*b* inner conductor
51, 51*a*, 51*b* outer conductor

The invention claimed is:

1. A coil component comprising:

an insulating layer having an annular coil core embedded; and a coil electrode wound around the coil core, wherein the coil electrode includes a plurality of first wiring patterns arranged on a first principal surface of the insulating layer, one end of each of the first wiring patterns being disposed at an inner peripheral side of the coil core and another end of each of the first wiring patterns being disposed at an outer peripheral side of the coil core, a plurality of second wiring patterns arranged on a second principal surface of the insulating layer such that each of the second wiring patterns forms a pair with a corresponding one of the first wiring patterns, one end of each of the second wiring patterns being disposed at the inner peripheral side of the coil core and another end of each of the second wiring patterns being disposed at the outer peripheral side of the coil core, a plurality of inner conductors disposed at the inner peripheral side of the coil core, each of the inner conductors connecting the one end of the corresponding one of the first wiring patterns and the one end of a corresponding one of the second wiring patterns forming the pair with the first wiring pattern, and a plurality of outer conductors disposed at the outer peripheral side of the coil core, each of the outer conductors connecting the other end of the corresponding one of the first wiring patterns and the other end of the corresponding one of the second wiring patterns adjacent to a second wiring pattern forming the pair with the first wiring pattern, wherein at least one of the first wiring patterns is such that an area of a section of each of the outer conductors connected to the other end, perpendicular to a thickness direction of the insulating layer is larger than an area of a section of each of the inner conductors connected to the one end, perpendicular to the thickness direction of the insulating layer, wherein at least one of the first wiring patterns or the second wiring patterns includes an underlying electrode and a surface electrode that is provided on the underlying electrode, wherein the surface electrode covers at least partially side surfaces of the underlying electrode, wherein the plurality of the inner conductors includes a columnar conductor and the plurality of the outer conductors includes one or more columnar conductors, each columnar conductor formed from a metal pin, and wherein the underlying electrode and the surface electrode are in contact with the columnar conductor of the inner conductors or the one or more columnar conductors of the outer conductors.

2. The coil component according to claim 1, wherein a total cross-sectional area of the one or more columnar conductors of the plurality of the outer conductors is greater than a cross-sectional area of the columnar conductor of the plurality of the inner conductors.

3. The coil component according to claim 1, wherein each of the inner conductors includes at least two inner columnar conductors, each of the outer conductors includes outer columnar conductors larger in number than the inner conductors, and a total of areas of sections of the outer columnar conductors perpendicular to the thickness direction of the insulating layer is greater than a total of areas of sections of the inner columnar conductors perpendicular to the thickness direction of the insulating layer.

4. The coil component according to claim 2, wherein each of the outer columnar conductors is thicker than each inner columnar conductor.

5. The coil component according to claim 2, wherein each of the inner columnar conductors is thicker than each of the outer columnar conductors.

6. The coil component according to claim 1, wherein the one or more columnar conductors of the plurality of outer conductors are arranged in one row along an outer periphery of the coil core.

7. The coil component according to claim 3, wherein each of the outer columnar conductors is thicker than each inner columnar conductor.

8. The coil component according to claim 3, wherein each of the inner columnar conductors is thicker than each of the outer columnar conductors.

9. The coil component according to claim 3, wherein the outer columnar conductors are arranged in one row along an outer periphery of the coil core.

10. The coil component according to claim 4, wherein the outer columnar conductors are arranged in one row along an outer periphery of the coil core.

11. The coil component according to claim 5, wherein the outer columnar conductors are arranged in one row along an outer periphery of the coil core.

12. The coil component according to claim 3, wherein each of the inner columnar conductors and each of the outer columnar conductors are formed from a metal pin.

13. The coil component according to claim 4, wherein each of the inner columnar conductors and each of the outer columnar conductors are formed from a metal pin.

14. The coil component according to claim 5, wherein each of the inner columnar conductors and each of the outer columnar conductors are formed from a metal pin.

15. The coil component according to claim 1, wherein upper end surfaces of the metal pins of the inner columnar conductor and the outer metal outer columnar conductors are exposed from the second principal surface of the insulating layer, and lower end surfaces of the metal pins of the inner columnar conductor and the outer metal outer columnar conductors are exposed from the first principal surface of the insulating layer.

16. The coil component according to claim 1, wherein the metal pin is disposed below at least a portion of the underlying and surface electrodes.

17. The coil component according to claim 1, wherein the metal pin comprises a sheared metal wire rod whose transverse section is of a predetermined shape.

* * * * *